US005421045A

United States Patent [19]

Bowen

[11] Patent Number: 5,421,045

[45] Date of Patent: Jun. 6, 1995

[54] SOFT SCULPTURE CONVERTIBLE TO BLANKET WITH PILLOW

[76] Inventor: Frances B. Bowen, 606 Otter Creek Landing, Carolina Beach, N.C. 28428

[21] Appl. No.: 190,903

[22] Filed: Feb. 3, 1994

[51] Int. Cl.[6] ..... A47G 9/02

[52] U.S. Cl. ..... 5/485; 5/482; 5/502; 446/73

[58] Field of Search ..... 5/482, 485, 419, 413, 5/502; 446/71, 73; D6/598, 599, 597, 603

[56] References Cited

U.S. PATENT DOCUMENTS

| | | | |
|---|---|---|---|
| D. 256,202 | 8/1980 | Schmickel et al. | D6/598 |
| D. 289,820 | 5/1987 | Paik et al. | D6/598 |
| D. 295,008 | 4/1988 | Codding et al. | D6/598 |
| D. 300,681 | 4/1989 | DeMars | D6/598 |
| D. 305,844 | 2/1990 | Chang | D6/598 |
| D. 318,503 | 7/1991 | Danova | D21/159 |
| D. 328,665 | 8/1992 | McNaughton | D2/25 |
| 2,038,338 | 4/1936 | Aronow | 5/485 |
| 2,711,546 | 6/1955 | Licht | 5/485 |
| 3,082,437 | 3/1963 | Upthagrove | 5/419 |
| 4,590,633 | 5/1986 | Pickens | 5/482 |
| 4,754,512 | 7/1988 | Chao-Yang | 5/482 |
| 4,856,131 | 8/1989 | Mills | 5/413 |
| 5,084,930 | 2/1992 | Danova | 5/502 |
| 5,093,947 | 3/1992 | Henegar et al. | 5/419 |

*Primary Examiner*—Alexander Grosz

*Attorney, Agent, or Firm*—Richard W. Evans; Michael G. Johnston; Moore & Van Allen

[57] ABSTRACT

A soft sculpture which is convertible to a blanket with a pillow, having a hollow body portion including an opening for receiving and storing a blanket therein. The blanket may be stored in the hollow body portion with the blanket being substantially enclosed within the body portion to form a three-dimensional toy. The blanket may be removably or fixably attached to the body portion and is removable through the opening of the body portion for use as bedding. The blanket further includes a pocket having an opening for receiving the soft sculpture therein to form a pillow. The body portion may be embellished with a head portion having an image bearing surface and appropriate appendages and a pocket for receiving a book.

26 Claims, 5 Drawing Sheets

SOFT SCULPTURE CONVERTIBLE TO BLANKET WITH PILLOW

BACKGROUND

This invention relates to a soft sculpture convertible to a blanket with pillow and, more particularly, to a hollow soft sculpture such as a stuffed animal or the like for storing a blanket therein, the blanket having a pocket for receiving the soft sculpture to form a pillow.

The concept of creating articles of bedding, including blankets and the like, which may be folded and stored when not in use to create an object having a utility other than that for which it was primarily designed is known in the art. Such articles generally include a doll or a stuffed toy animal with bedding attached thereto. Once the bedding is rolled up, it may be selectively secured in a rolled configuration behind the doll or received and securely enclosed therein. In the latter embodiment, the doll or toy body has an opening for receiving and storing the bedding in the body to form a stuffed doll or toy. The bedding can be removed out of the body for use as a blanket. In this position, the doll or toy may or may not be accessible to the person covered by the blanket. However, none of the articles taught by the prior art include a selectively detachable blanket which allows the doll or toy to be freely removed from the blanket.

Furthermore, pillow means are seldom provided with dolls or toys convertible to bedding. In the past, where pillow means have been provided, an additional element has been introduced. For example, an air cell, to be inflated and reinserted into the body after the blanket is removed, may be provided for use as a pillow element. None of the conventional convertible bedding articles provide for a pillow without requiring independent pillow means, such as additional stuffing material, or a pillow element as described above.

For the foregoing reasons, there is a need for a soft sculpture and blanket including means for forming a pillow when the blanket is in use. There is also a need for a soft sculpture with blanket wherein the soft sculpture is removably attached to the blanket so as to be freely moveable by a user, such as a child.

SUMMARY

The present invention is directed to an article that satisfies these needs comprising a soft sculpture which is convertible to a blanket with a pillow, having a hollow body portion including an opening for receiving and storing a blanket therein. The blanket may be stored in the hollow body portion with the blanket being substantially enclosed within the body portion to form a three-dimensional toy. The blanket is removable through the opening of the body portion for use as bedding. The blanket further includes a pocket having an opening for receiving the soft sculpture therein to form a pillow.

The blanket is attached to the body portion of the soft sculpture in a position so that the soft sculpture is substantially aligned with the opening of the pocket of the blanket. The blanket may be fixably attached to the body portion such as by stitching. Alternatively, the blanket can be removably attached to the body portion of the soft sculpture. The soft sculpture then becomes freely moveable with respect to the blanket.

The soft sculpture may optionally include a head portion affixed to the body portion, the head portion having a facial image applied or affixed to the exposed surface of the head portion so as to be visible externally of the soft sculpture. The body portion and head portion of the soft sculpture can be further adorned with one or more appendages comprising, for example, a leg, an ear or a tail. A further embodiment of the present invention includes affixing a pocket to the body portion for receiving a book therein.

The soft sculpture is convertible between a functional toy in the nature of a stuffed animal, doll or the like in which the blanket is disposed within the hollow body portion of the soft sculpture, and a blanket and a toy in a second configuration. The blanket is removed out of the soft sculpture so that it can be spread and used as bedding, while the soft sculpture remains visible and usable as a toy either attached to or detached from the blanket, or is stored inside the pocket of the blanket thereby forming a pillow. Thus, the present invention may be used as a stuffed toy, a blanket with pillow or a blanket and toy.

DRAWINGS

These and other features, aspects and advantages of the present invention will become better understood with regard to the following description, appending claims and accompanying drawings where:

DESCRIPTION

Figure 1:
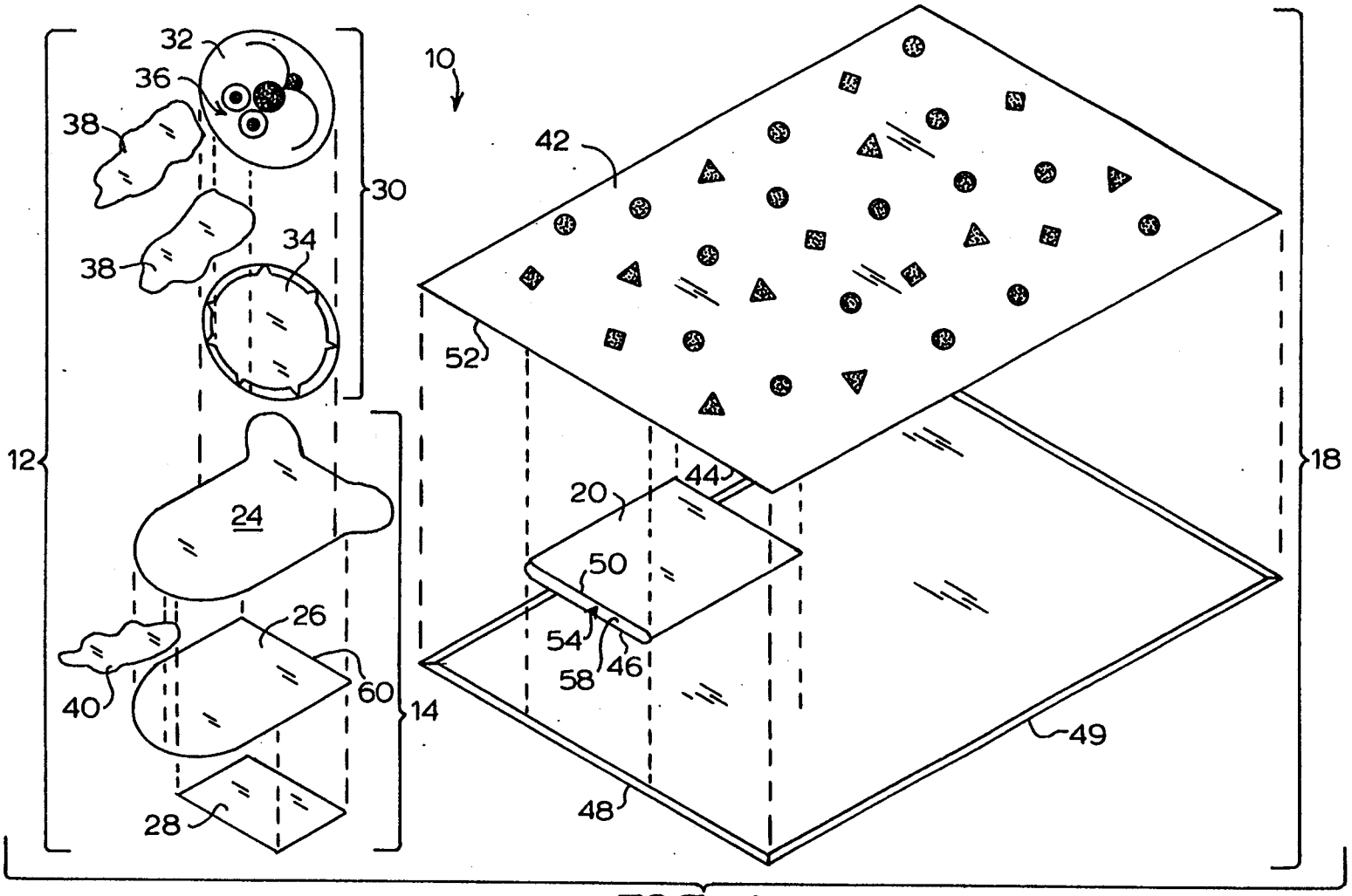
FIG. 1 is an exploded perspective view of an embodiment of the present invention.
Figure 2:
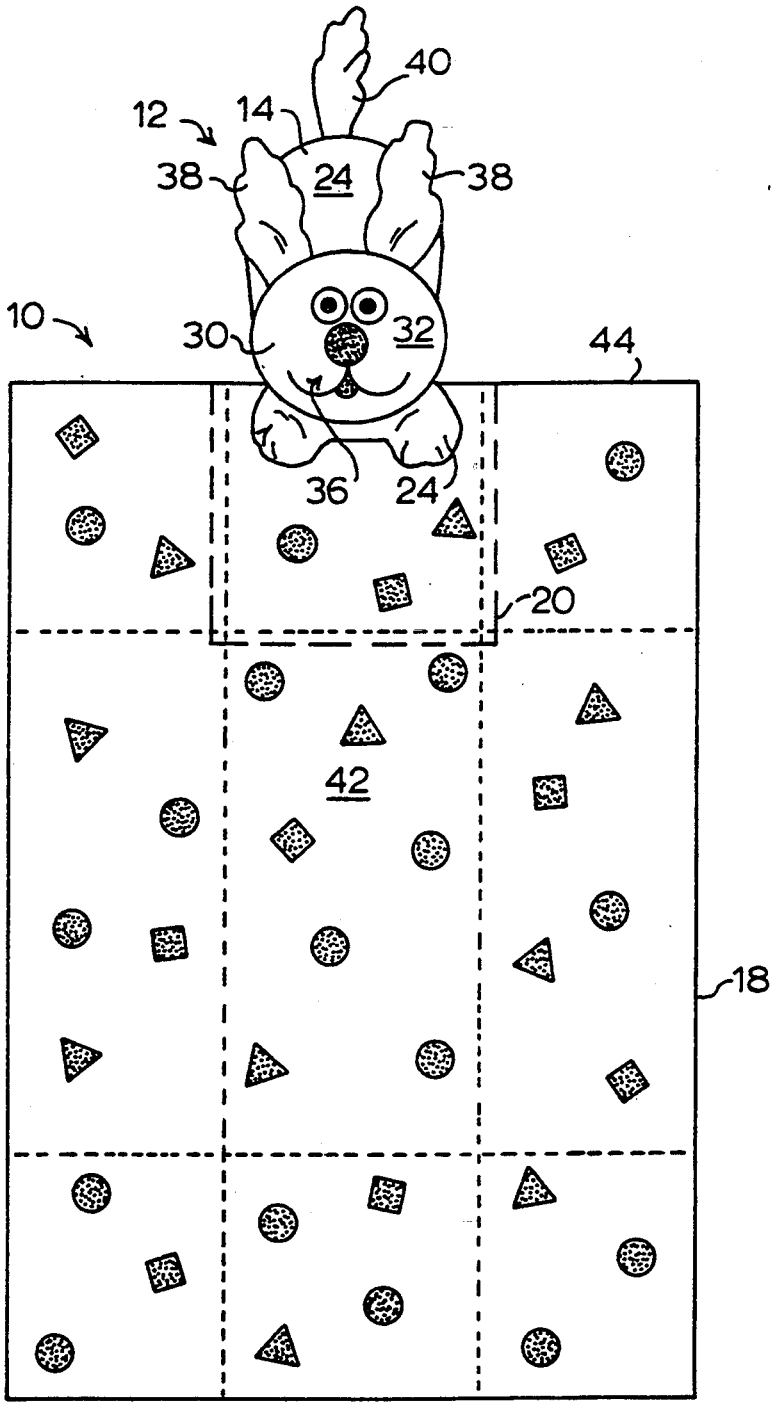
FIG. 2 is a perspective view of an embodiment of the present invention wherein the blanket is unfolded and extended.

With continued reference to the drawings, an embodiment of the present invention, denoted generally by the numeral 10, is shown in the form of a dog, although any type of real or imaginative creature or object may be depicted by the soft sculpture. The term "blanket" as used herein generally denotes any covering of blanket type which is useful as bedding, including but not limited to a quilt, comforter, coverlet, afghan, bedsheet, bedspread, sleeping bag and the like. The soft sculpture 12 comprises a hollow body portion 14 including an opening 16 for receiving and storing therein a blanket 18. The blanket 18 has a pocket 20 for receiving the soft sculpture 12 to form a pillow 22.

The construction of an embodiment of the present invention is shown in the greatest detail in the exploded perspective view of FIG. 1. The body portion 14 comprises a front panel 24 and a back panel 26. The front panel 24 and back panel 26 are substantially identically shaped. However, the front panel 24 may include variations with respect to the back panel 26 in order to more closely resemble the figure or object being depicted.

Figure 3:
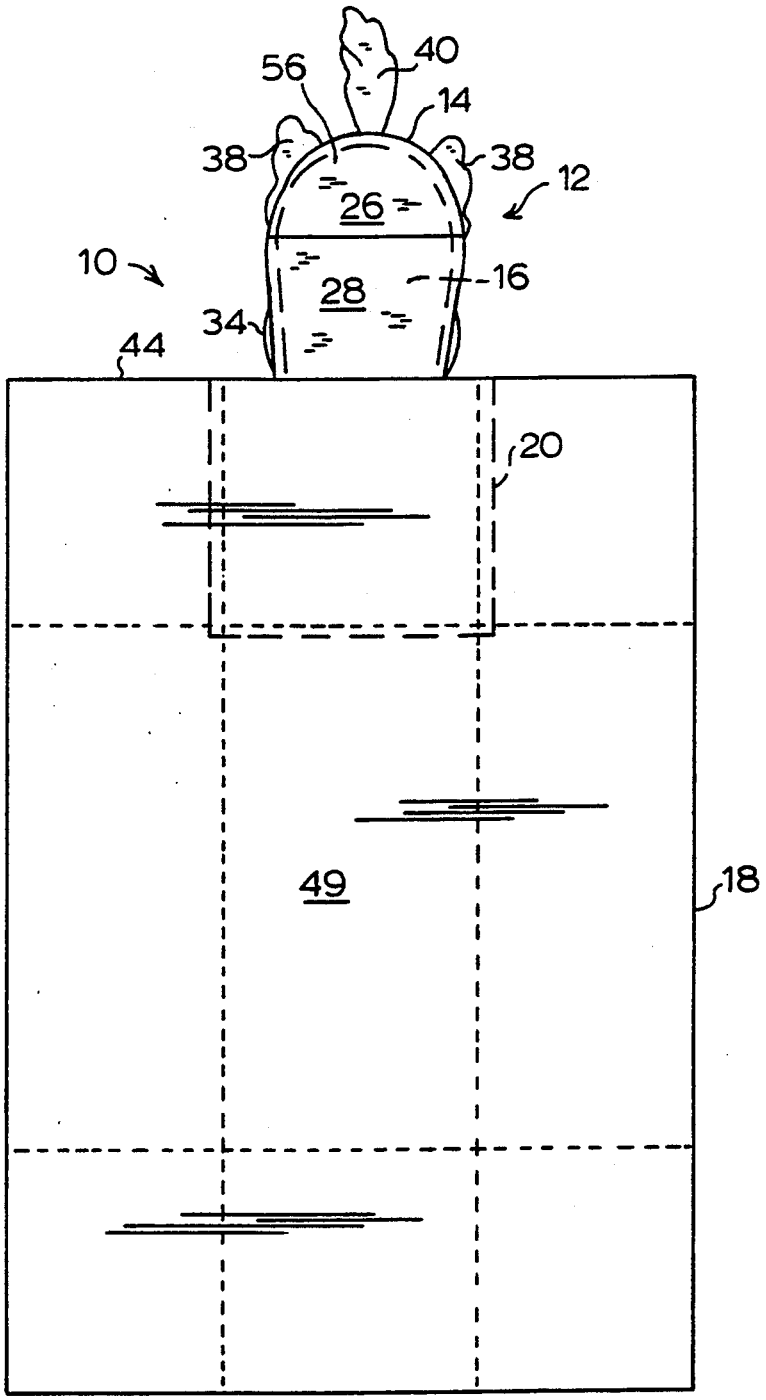
FIG. 3 is a backside perspective view of the embodiment of the present invention shown in FIG. 2.

The material used for the construction of the body portion 14 of the soft sculpture 12 is generally flexible material, preferably common, washable textile fabric. Preferably, the material is also sufficiently resilient to maintain the shape of the imaginative creature or object depicted by the soft sculpture 12 when the blanket 18 is removed from the body cavity and to create a soft, cushiony effect similar to that of a bed pillow. In a preferred embodiment of the present invention, the front panel 24 and back panel 26 each consist of three layers. The top and bottom layers are comprised of common textile fabric. The inner layer is resilient padding such as conventional batting, polyester fleece, cotton liners, shredded soft foam plastic resin or the like to give the body portion 14 of the soft sculpture 12 three-dimensional character. The front panel 24 and back panel 26 are secured together along the edges thereof, with the exception of the opening 16 in the body portion 14, thereby creating an open body cavity to receive the blanket 18. The means for securing the panels may be by stitching, using thermally or heat sensitive adhesive or the like. The preferred securing means is by stitching to form a seam. The hollow body portion 14 is of sufficient size to accommodate the blanket 18 therein. As shown in FIG. 3, a backside perspective view of an embodiment of the present invention 10 wherein the blanket 18 is unfolded and extended, the back panel 26 of the body portion 14 may also include a pocket 28 for receiving and storing a book (not shown).

If desired, a complementary head portion 30 may be affixed to the body portion 14 of the soft sculpture 12. The head portion 30 may be constructed and attached in any manner known in the art. The material of construction used for the head portion 30 in the preferred embodiment is generally flexible material which is also sufficiently resilient to maintain its shape. Preferably this material is common, washable textile fabric, but may also be molded plastic, foam rubber and the like.

In the preferred embodiment, the head portion 30 is constructed similarly to the body portion 14 comprising a front panel 32 and back panel 34, each of the panels secured together along the edges thereof by stitching, adhesive or the like, but preferably by stitching to form a seam. The front panel 32 and back panel 34 of the head portion 30 each consist of three layers, the top and bottom layer consist of common textile fabric and the inner layer preferably comprises a resilient padding such as conventional batting, polyester fleece, cotton liners, shredded soft foam plastic resin or the like to give the head portion 30 three-dimensional character.

The head portion 30 of the preferred embodiment has an image bearing surface 36 disposed outwardly of the soft sculpture 12. A facial image may be applied or affixed to the image bearing surface 36 of the head portion 30 so as to be visible externally of the soft sculpture 12. The facial image may bear a likeness to any real or fictional creature or object which is appealing to a particular child. The facial image is preferably applied by screen printing to the image bearing surface 36 of the head portion 30. Alternatively, the facial image may be affixed to the image bearing surface 36 by securing facial features to the head portion 30 such as by adhesive, stitching or the like.

Accordingly, the body portion 14 and head portion 30 of the soft sculpture 12 can be further adorned with one or more appendages. For example, ears 38 and a tail 40 may be attached to the head portion 30 and the body portion 14, respectively. The appendages may be of the same general construction as the body portion 14 and head portion 30 and affixed by stitching to the head portion 30 or body portion 14, or by any other suitable means. Alternatively, the appendages may be comprised of any flexible, resilient material such as molded plastic, foam rubber and the like. The appendages remain visible whether the blanket 18 is stored within the soft sculpture 12 or the blanket 18 is spread out and in use.

The blanket 18 may be of any size which is receivable in the body portion 14 of the soft sculpture 12. Preferably, the blanket 18 is at least of a size which is suitable for a small child. The shape of the blanket 18 may be rectangular, oblong, bag-shaped or itself the outline or shape of a real or imaginative creature or object. The blanket 18 may be of any type construction and material used for any covering of the blanket type. However, it must be constructed of flexible, resilient material, preferably common, washable textile fabric, so as to be compactible for storage in the body portion 14 of the soft sculpture 12. The blanket 18 can be quilted having a filling between front and back surfaces and may also, if desired, have a graphic design applied on the front surface 42. If quilted, or in the case of a comforter, the blanket 18 consists of three layers. The top and bottom layer consist of material comprising washable fabric and may be in contrasting colors. The interior layer is conventional batting, polyester fleece, cotton liners, shredded soft foam plastic resin or the like.

In the preferred embodiment the blanket 18 has a pocket 20 affixed at its perimeter 44. The pocket 20 is sized to receive the soft sculpture 12 to form a pillow 22 for use with the blanket 18. The pocket 20 is attached to the blanket by any suitable means such as by top-stitching, both vertically and horizontally. Where the blanket 18 is comprised of multiple layers, the pocket 20 may be formed between the top layer of fabric and the interior layer. The top edge of the back 46 of the pocket 20 is attached at the top edge 48 of the back surface 49 of the blanket 18, and the top edge of the front 50 of the pocket 20 is attached to the top edge 52 of the front surface 42 of the blanket 18 thereby defining the pocket opening 54. If desired, means for securely closing the pocket 20 may be provided on the top interior of the pocket 20 such as snaps, buttons, hook and loop type strips and the like (not shown).

The attachment of the body portion 14 of the soft sculpture 12 to the blanket 18 may be more readily understood by reference to FIG. 1 and FIG. 3. The blanket 18 is attached to the body portion 14 in a position such that the soft sculpture 12 is substantially aligned with the opening 54 of the pocket 20 of the blanket 18 with the outer surface 56 of the back panel 26 of the body portion 14 aligned adjacent to the inner surface 58 of the top edge of the back 46 of the pocket 20. The body portion 14 is fixably attached to the blanket 18 by any suitable means, but preferably by stitching the lower edge 60 of the outer surface 56 of the back panel 26 of the body portion 14 to the top edge 52 of the front surface 42 of the blanket 18 centered between the extremes of the top edge of the back 46 of the pocket opening 54, forming a seam.

Alternatively, the body portion 14 can be removably attached to the blanket 18. For example, means for removably attaching the blanket 18 to the body portion 14 may be affixed to the top edge 48 of the back surface 49 of the perimeter 44 of the blanket 18 adjacent to and centrally located on the opening 54 of the pocket 20, and to the lower edge 60 of the outer surface 56 of the back panel 26 of the body portion 14 thereby allowing the soft sculpture 12 to be detached from the blanket 18. The attaching means may be any type of fastener such as adhesive strips, snaps, buttons and the like, or material which adheres to each other such as hook and loop type fasteners. The attaching means may be secured to the body portion 14 and blanket 18 by stitching or other suitable means. Alternatively, the soft sculpture 12 may be fixably or removably tethered to the blanket 18 to provide a greater range of movement of the soft sculpture 12 in relation to the blanket 18 while reducing the risk of the child misplacing the soft sculpture 12.

Figure 4:
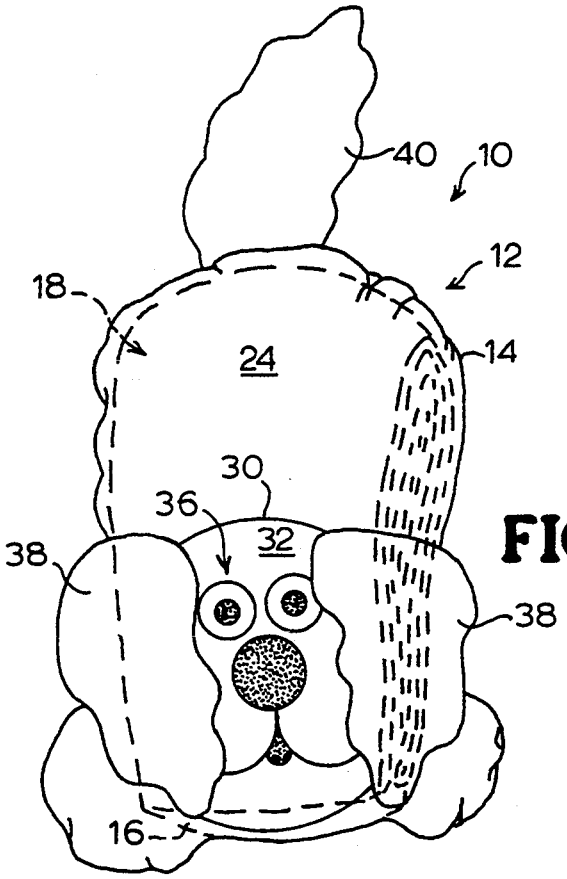
FIG. 4 is a frontal view of an embodiment of the present invention wherein the bedding material is compacted by at least one of folding, rolling and wadding up and is stored in the body cavity of the soft sculpture to form a fully stuffed toy configuration.

The present invention 10 may be used as either a soft sculpture toy or as a blanket or bedding. FIG. 4 shows the soft sculpture convertible to a blanket with pillow 10 in a first disposition with the blanket 18 disposed within the body portion 14 to form a three-dimensional toy. The blanket 18 is compacted by at least one of folding, rolling and wadding up and is placed through the opening 16 of the hollow body portion 14 and into the body cavity. The blanket 18 is substantially enclosed within the body portion 14. The blanket 18 thus becomes a filler to give the body portion 14 an enhanced three-dimensional character and form the soft sculpture creature or object. Preferably, the combination of the flexible, resilient nature of the blanket material and appropriate sizing of the blanket and the hollow cavity in the body portion 14 are such that the blanket 18 fits snugly within the body portion 14 so that a closure device or a securing means to hold the blanket 18 within the body portion 14 are unnecessary.

Figure 6:
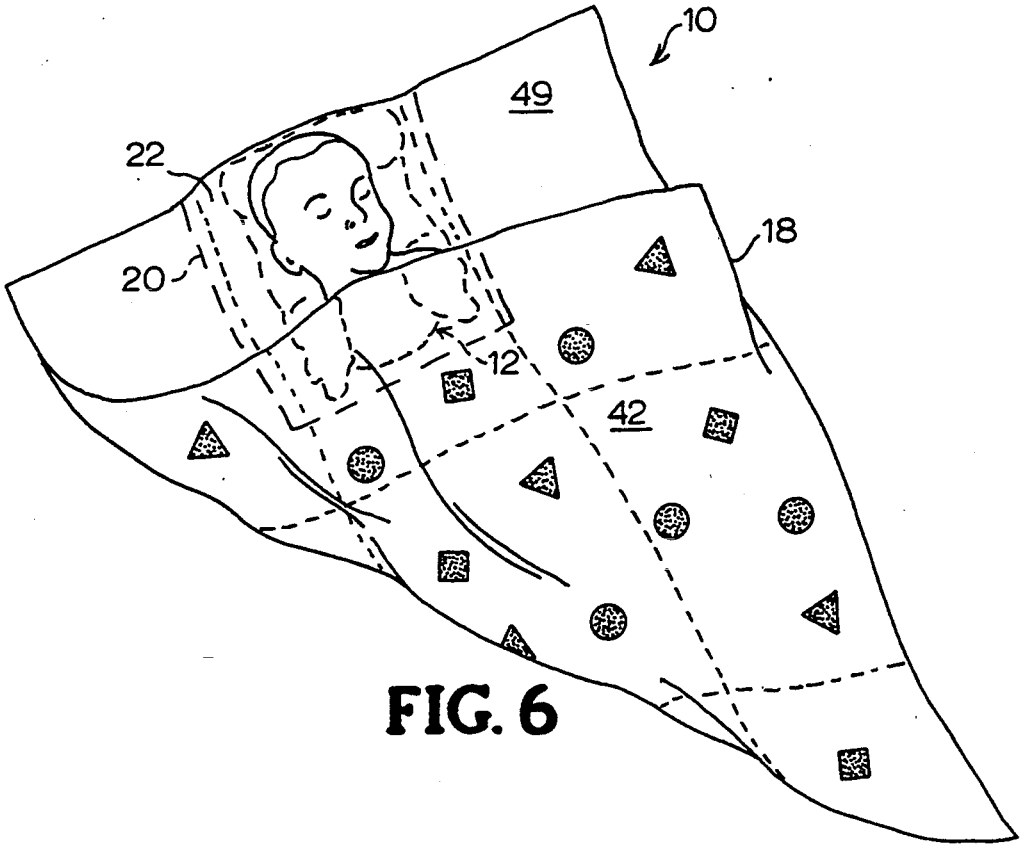
FIG. 6 is a perspective view from above, of a child with his head on the pillow formed by storing the soft sculpture in the pocket of the blanket in its unstuffed configuration.
Figure 5:
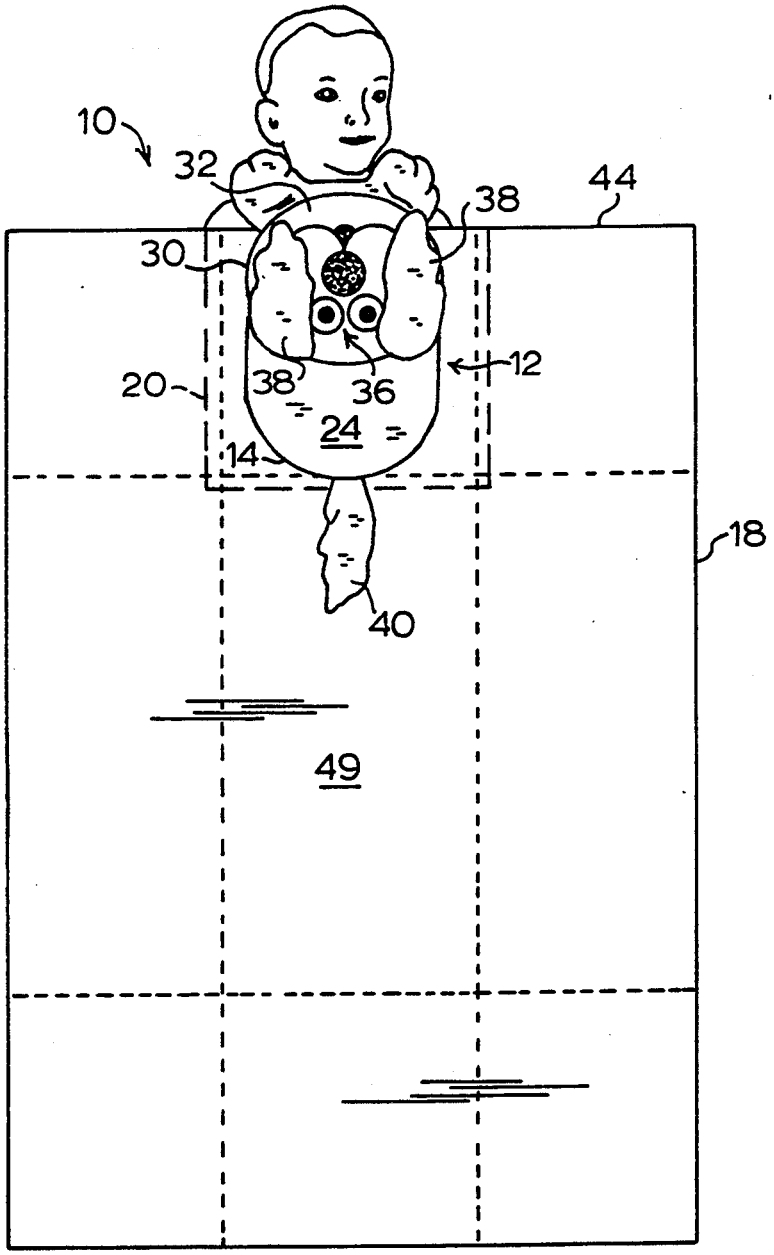
FIG. 5 is a perspective view from above, of a child under the blanket while snuggling the soft sculpture.

As shown in FIG. 5 and FIG. 6, the blanket 18 is removable through the opening 16 of the body portion 14 for use in a second disposition as a blanket or bedding. In the second disposition, with the blanket 18 spread out, the soft sculpture 12 may be stored in the pocket 20 of the blanket 18 to form a pillow 22. Alternatively, where the body portion 14 is removably attached to the blanket 18, the soft sculpture 12 may be removed from the blanket 18 in the second disposition to be freely moveable for the child to hold and snuggle. As noted above, the soft sculpture 12 may also be tethered to the blanket 18.

The soft sculpture convertible to a blanket with pillow 10 has many advantages. A child can store his or her blanket 18 in the soft sculpture 12 when not in use to render the blanket 18 easily transportable. The blanket 18 is thereby spared the abuse of being dragged about by the child. As shown in FIG. 5, when the blanket 18 is being used as a covering, the attached soft sculpture 12 toy is accessible to the child with the facial image of the head portion 30 of the soft sculpture 12 toward the child's face.

As shown in FIG.6, when the soft sculpture 12 is disposed within the pocket 20 of the blanket 18, a pillow 22 is formed of sufficient size and thickness for the average child. The blanket 18 can further be pulled around or over the child while the child's head is on the pillow 22. Furthermore, in the preferred embodiment, the soft sculpture 12 and blanket 18 are washable and durable.

Although the present invention has been described in considerable detail with reference to certain preferred versions thereof, other versions are possible. For example, the soft sculpture can be of any size or shape resembling any real or imaginative creature or object. The material of construction of the soft sculpture can be any flexible, resilient material including cloth, fabric, plastic and the like, or a foam-like fabric with no need for padding to give the soft sculpture its desired shape. Additionally, as an alternative to stitching, the material may secured together using thermally or heat sensitive adhesive. Therefore, the spirit and scope of the appending claims should not be limited to the description of the preferred versions contained herein.

What is claimed is:

1. A soft sculpture which is convertible to a blanket, comprising:

a. a hollow body portion including an opening for receiving and storing bedding therein;

b. a blanket of a size suitable for a child, having a front surface, a back surface and a perimeter including an edge, which in a first disposition is compacted by at least one of folding, rolling and wadding up and is placed through said opening in said hollow body portion with said blanket being substantially enclosed within said body portion to form a soft sculpture object or toy, and said blanket removable through said opening of said body portion for use in a second disposition as a bedding or blanket, said blanket including a pocket having an opening along said perimeter of said blanket for receiving said body portion therein to form a pillow; and c. means for attaching said blanket to said body portion.

2. The soft sculpture which is convertible to a blanket according to claim 1, wherein said hollow body portion further comprises a front panel and a rear panel, each of said panels having an inner surface and an outer surface, said panels secured together along the edges thereof except across said opening.

3. The soft sculpture which is convertible to a blanket according to claim 2, wherein said front panel and said rear panel of said body portion are made of a flexible material.

4. The soft sculpture which is convertible to a blanket according to claim 3, wherein said flexible material of said body portion is made at least predominantly of textile fabric.

5. The soft sculpture which is convertible to a blanket according to claim 1, further comprising a head portion affixed to said outer surface of said front panel of said body portion.

6. The soft sculpture which is convertible to a blanket according to claim 5, wherein said head portion further comprises a front panel and a back panel, said panels secured together along the edges thereof, said front panel of said head portion having an image bearing surface disposed outwardly of the soft sculpture.

7. The soft sculpture which is convertible to a blanket according to claim 6, wherein said front panel and said rear panel of said head portion are made of a flexible material.

8. The soft sculpture which is convertible to a blanket according to claim 7, wherein said flexible material of said head portion is made at least predominantly of textile fabric.

9. The soft sculpture which is convertible to a blanket according to claim 8, wherein said head portion further comprises a facial image applied to said image bearing surface of said front panel so as to be visible externally of said soft sculpture.

10. The soft sculpture which is convertible to a blanket according to claim 5, wherein said soft-sculpture object further comprises at least one appendage attached by end thereof to said head portion.

11. The soft sculpture which is convertible to a blanket according to claim 10, wherein said at least one appendage further comprises a front panel and a back panel, said panels secured together along the edges thereof.

12. The soft sculpture which is convertible to a blanket according to claim 10, wherein said at least one appendage is made of flexible material.

13. The soft sculpture which is convertible to a blanket according to claim 12, wherein said flexible material of said at least one appendage is made at least predominantly of textile fabric.

14. The soft sculpture which is convertible to a blanket according to claim 13, wherein said at least one appendage attached by said end thereof to said body portion comprises an ear.

15. The soft sculpture which is convertible to a blanket according to claim 1, wherein said blanket is a quilt having a filling between said front and back surfaces.

16. The soft sculpture which is convertible to a blanket according to claim 1, wherein said means for attaching said blanket to said body portion is permanent and said body portion is substantially aligned with said opening of said pocket of said blanket.

17. The soft sculpture which is convertible to a blanket according to claim 1, wherein said attaching means is a means for removably attaching said blanket to said body portion.

18. The soft sculpture which is convertible to a blanket according to claim 17, wherein said means for removably attaching said blanket to said body portion is affixed to said edge of said perimeter of said blanket adjacent to said opening of said pocket of said blanket and to said outer surface of said rear panel of said body portion.

19. The soft sculpture which is convertible to a blanket according to claim 18, wherein said means for removably attaching said blanket to said body portion comprises fastening strip(s) which are capable of adhering to each other.

20. The soft sculpture which is convertible to a blanket according to claim 19, wherein said fastening strips are complementary strips of hook and loop type fastener.

21. The soft sculpture which is convertible to a blanket according to claim 1, further comprising a pocket means affixed to said outer surface of said rear panel of said body portion for receiving a book therein.

22. The soft sculpture which is convertible to a blanket according to claim 1, wherein said soft sculpture toy further comprises at least one appendage attached by an appropriate end thereof to said body portion.

23. The soft sculpture which is convertible to a blanket according to claim 22, wherein said at least one appendage further comprises a front panel and a back panel, said panels secured together along the edges thereof.

24. The soft sculpture which is convertible to a blanket according to claim 22, wherein said at least one appendage is made of flexible material.

25. The soft sculpture which is convertible to a blanket according to claim 24, wherein said flexible material of said at least one appendage is made at least predominantly of textile fabric.

26. The soft sculpture which is convertible to a blanket according to claim 25, wherein said at least one appendage attached by said end thereof to said body portion comprises a tail attached to said body portion.

* * * * *